United States Patent [19]

Kirk

[11] Patent Number: 4,553,675

[45] Date of Patent: Nov. 19, 1985

[54] HYDRAULICALLY OPERATED CRANES

[76] Inventor: Geoffrey F. Kirk, 30 Freyberg Crescent, Waikanae Beach, New Zealand

[21] Appl. No.: 444,302

[22] Filed: Nov. 24, 1982

[30] Foreign Application Priority Data

Nov. 26, 1981 [NZ] New Zealand ..... 199082

[51] Int. Cl.[4] ..... B66C 11/16

[52] U.S. Cl. ..... 212/205; 212/213; 212/217

[58] Field of Search ..... 212/119, 124–132, 212/133, 205–221, 225–228, 257; 254/228, 385, 386, 387; 104/98

[56] References Cited

U.S. PATENT DOCUMENTS

| | | | |
|---|---|---|---|
| 435,164 | 8/1890 | Wood | 212/214 |
| 2,983,390 | 5/1961 | Lang et al. | 212/205 |
| 2,984,191 | 5/1961 | Smith | 104/98 |
| 3,113,681 | 12/1963 | Crile | 212/228 |
| 3,294,252 | 12/1966 | Hosoi et al. | 212/205 |
| 3,575,300 | 4/1971 | Durand | 212/228 |
| 3,588,049 | 6/1971 | Nectoux | 254/387 |
| 3,907,120 | 9/1975 | Johnston et al. | 212/124 |
| 4,343,406 | 8/1982 | Noly | 212/225 |
| 4,411,070 | 10/1983 | Boyum et al. | 212/264 |

FOREIGN PATENT DOCUMENTS

| | | | |
|---|---|---|---|
| 954653 | 4/1964 | United Kingdom | 212/205 |

*Primary Examiner*—Trygve M. Blix
*Assistant Examiner*—Stephen P. Avila
*Attorney, Agent, or Firm*—Ladas & Parry

[57] ABSTRACT

A hydraulically operated crane of either the jib or bridge type with the hoist block supported from a trolley movable along the support structure provided by the jib or bridge. The rope and sheave system to control the lifting and lowering of the hoist block provides a balanced fleet through system and the actuating power for the system is provided by a special hydraulic multiplying linear motor mounted in the jib or bridge. The arrangement of the sheaves is such that movement of the multiplying linear motor causes travel of the hoist rope to be balanced about the hoist block with the rope taken in or let out evenly over the trolley sheaves.

10 Claims, 14 Drawing Figures

Figure 1:
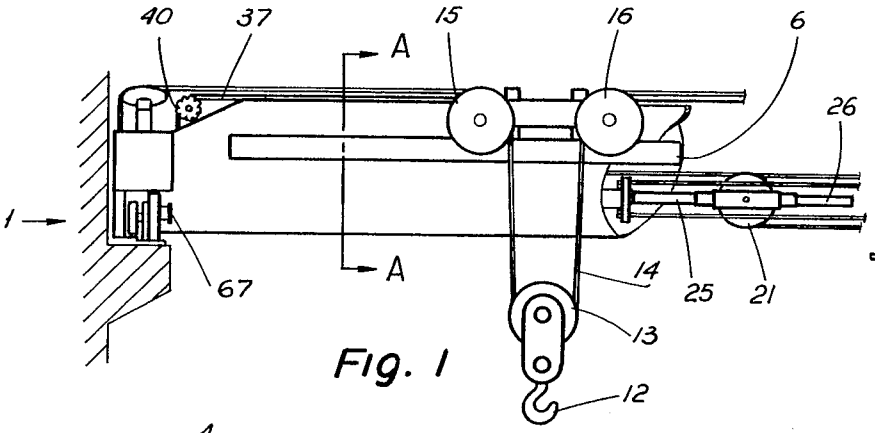

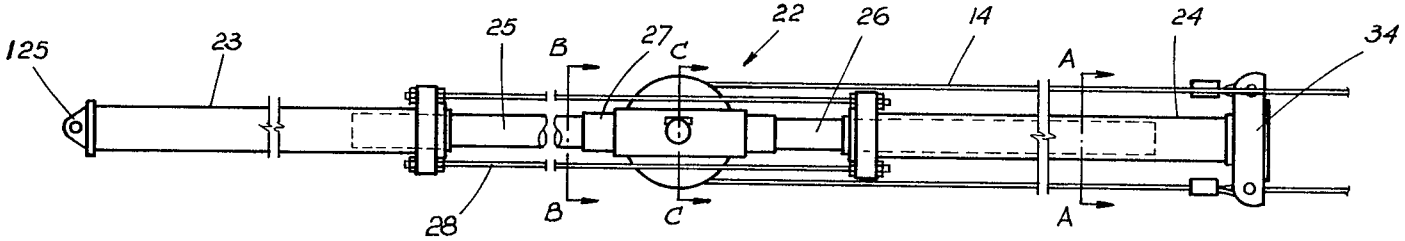
Fig. 4
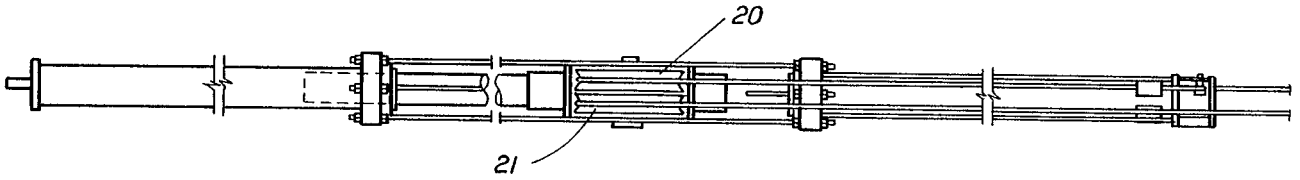
Fig. 5
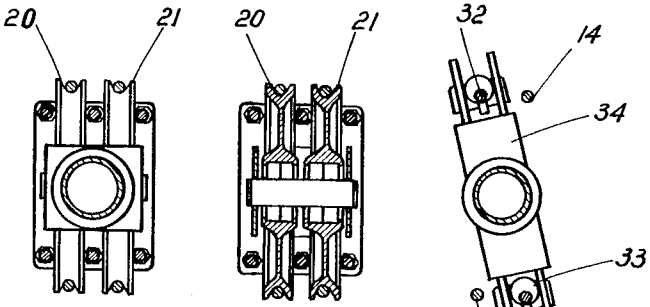
Fig. 7
Fig. 8
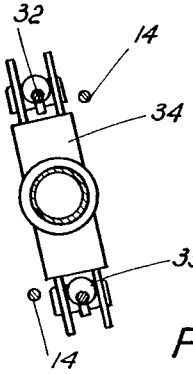
Fig. 9
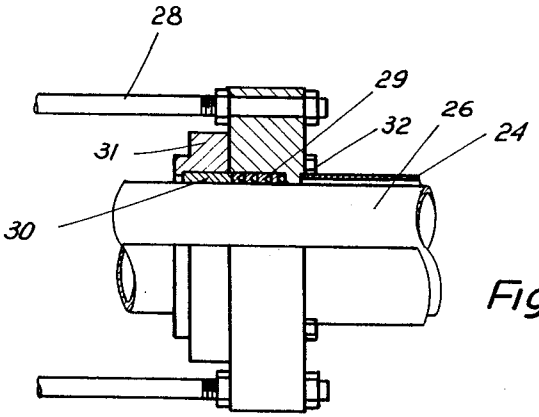
Fig. 6

HYDRAULICALLY OPERATED CRANES

This invention relates to hydraulically operated cranes.

BACKGROUND

The use of hydraulic power to operate cranes has been known and examples appear in the patent literature from an early time. Some of the more recent and more sophisticated examples can be found in U.S. Pat. Nos. 2,906,143, 2,984,191, 3,872,671, 3,872,674 and 3,907,120. Examples are also found in British patent literature and reference is made to British Pat. No. 954,652 and No. 954,653.

Despite recognizing the possibility of adopting hydraulic prime movers the hydraulic crane has not met with any significant commercial success. There are many reasons which contribute to this but principal among the stated or acknowledged disadvantages is the tendency for hydraulic motors to leak or discharge oil. This is viewed as very undesirable in most situations where cranes will operate.

I believe the advantages which can be secured from the successful operation of a hydraulic crane considerably outweighs the disadvantages particularly in view of the very high component cost necessary in an electrically powered crane and the high maintenance costs required to ensure satisfactory long term operation of such a crane. By way of an example of such a disadvantage reference is specifically made to the energy dissipation means which must be incorporated in an electrically powered crane and these overheat and can lead to high maintenance costs or failure. I believe all these disadvantages can be overcome by the adoption of a hydraulically operated crane.

THE PRESENT INVENTION

Accordingly it is an object of the present invention to provide a hydraulically operated crane which will allow the advantages of a hydraulic system as opposed to an electrically operated crane system to be fully realised while also minimising what has traditionally been accepted as the disadvantages of the hydraulic system.

It is another objective to introduce a means whereby forces in the hydraulic operating system are balanced tending to minimise wear or stress on some components and allowing for balanced and controlled movement of the load.

Accordingly in one aspect the invention consists in a hydraulically operated crane comprising a support structure incorporating trolley tracks, a trolley traversible across said support structure, a hoist block supported from said trolley, rope and sheave system in said support structure to control the lifting or lowering of the hoist block and a separate sheave system in said support structure to control the traversing of the trolley across the support structure, with the rope and sheave system for the hoist providing a balanced fleet through system and with the actuating power for this system provided by a hydraulic multiplying linear motor mounted in said support structure.

The support structure will usually comprise the jib of a power crane or the bridge of a travelling or fixed bridge crane.

A balanced fleet through system is easily achieved in the traversing mechanism by inserting a hydraulic multiplying linear motor in the support structure attached to the rope system controlling the movement or position of the trolley along that structure.

In the case of the hoist block the balanced fleet through system comprises two reeved sheaves movable by the hydraulic multiplying linear motor, a diverter sheave fixed in the structure and having the rope from one of the reeved sheaves attached to the hydraulic multiplying motor passed thereabout, end return sheaves in the structure, trolley sheaves and a hoist block, the construction and arrangement being such that with the introduction of the diverter sheave movement of the linear motor causes travel of the hoist rope to be balanced about the hoist block with the rope taken in or let out evenly over the trolley sheaves.

The hydraulic multiplying linear motor used can assume any known configuration which will move the reeved sheaves to achieve the motions previously setforth. However, I have devised a hydraulic multiplying linear motor of particular configurations which I believe overcomes a number of the difficulties previously accounted with hydraulic systems and which would have an application outside that specifically described with reference to the balanced fleet through system or indeed the crane itself.

Accordingly the hydraulic multiplying linear motor comprises twin opposed hydraulic cylinders, pistons operably arranged in said cylinders with each piston connected to he power take-off point, tie rods connecting the operating cylinders over the operating length of the motion possible with the pistons, said motor being supported at least by fixing the end of one cylinder in the support structure and appropriately supporting the other cylinder.

In the present invention the hydraulic multiplying linear motor is connected so that the reeved sheave carrier is mounted at the power take-off point.

The opposed pistons connected to the power take-off are hollow with stopped ends adjacent the power take-off point so that in use the interior of the piston is filled with ill under pressure. This has two advantages. It means the weight of the assembly tending to create any bowing or bending moment in the structure has a counter-balancing effect as a consequence of the bourdon effect. Also the piston having oil under pressure is a better load carrier in the operating conditions experienced by the hydraulic multiplying linear motor.

Preferably the cylinder head assembly carries the sealing rings and guide bush in a manner which ensures easy maintenance and replacement.

Preferably the ropes are anchored relative to the reeve sheaves so that the forces generated upon load being applied through the ropes tends to balance, preventing or minimising bending or eccentric load being placed on the pistons of the hydraulic multiplying linear motor.

The opposed cylinder linear motor also operates in conjunction with the control mechanism adopted to take advantage of the metering out principle for speed control.

The cylinders in the linear motor are balanced with the input to one cylinder balancing the output from the other cylinder in a manner such that the reserve supply of oil required in the system does not vary substantially. This allows a system to be operated either under a closed and controlled atmosphere or where there is little movement of air into and out of the reservoir tank thereby minimising the dirt and other extraneous material that might otherwise be introduced into the system.

The support structure member for a travelling bridge crane preferably comprises a hollow cylindrical structural member, a trolley engaged about part of the circumference of the cylindrical structural member and running on rails substantially diametrically opposed through the cylindrical structural member and with the linear motor and associated sheaves and rope reeving used in the crane mounted within the cylindrical structural member.

The trolley is designed to support a torsional load relative to the cylindrical structural member.

The hydraulic control circuit for the crane includes including a hydraulic pump, a directional control valve to actuate a hydraulic motor in a forward or reverse direction and to connect the exhaust circuit through a control valve and metering valve with the control and metering valve used to regulate the speed and acceleration of the hydraulic motor.

Preferably the control valve delivers a flow of oil to the metering valve which compresses a biassing spring and opens a needle valve.

Preferably the rate at which the oil is delivered to the metering valve and the rate from the which the oil is discharged from the valve in the control mode is the same and is independent of operator control.

DRAWING DESCRIPTION

Figure 3:
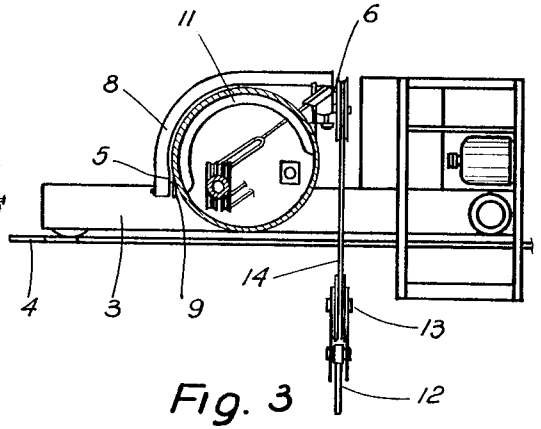
Figure 2:
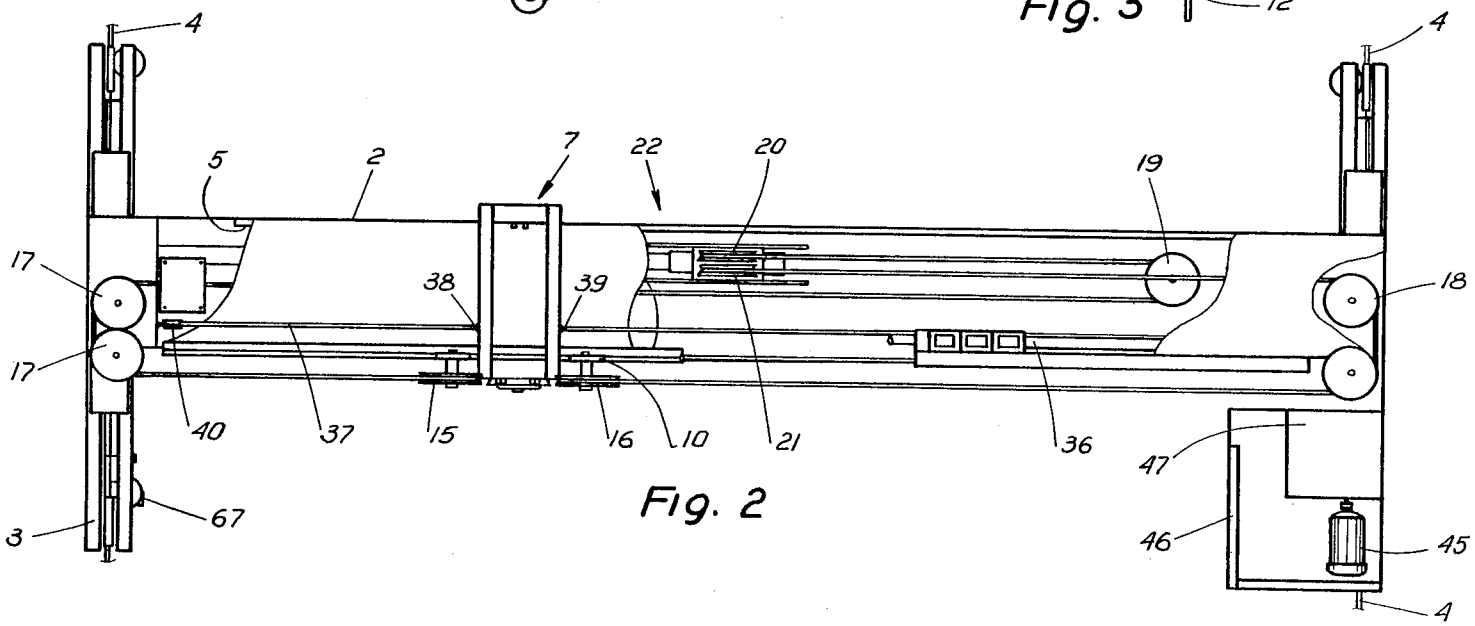
Figure 10:
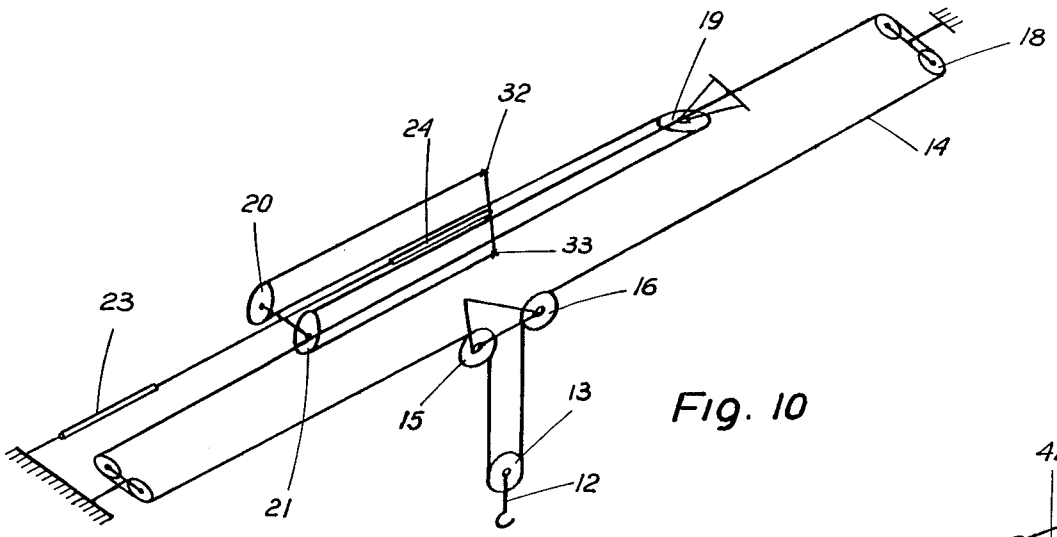
Figure 11:
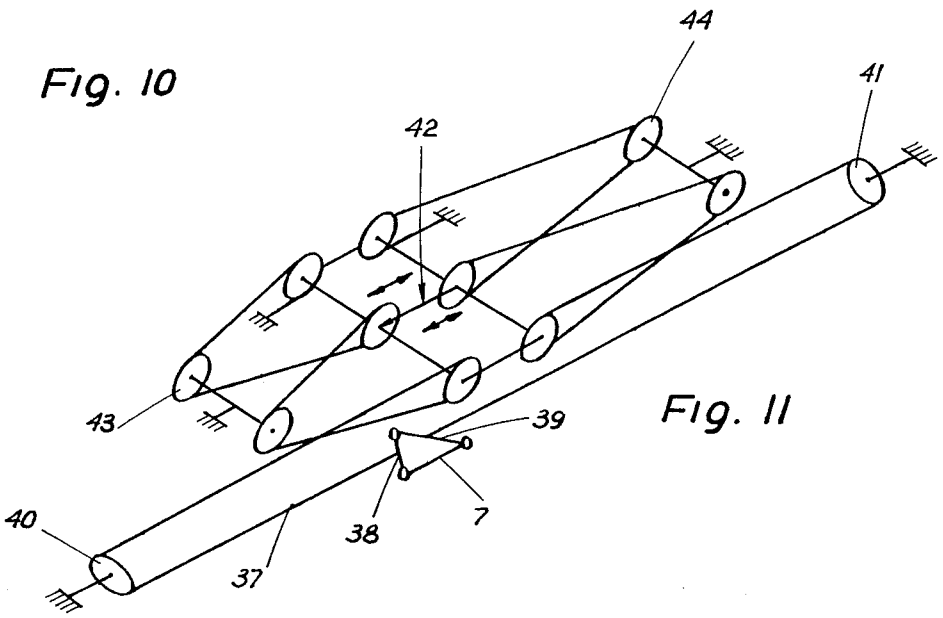
Figure 12:
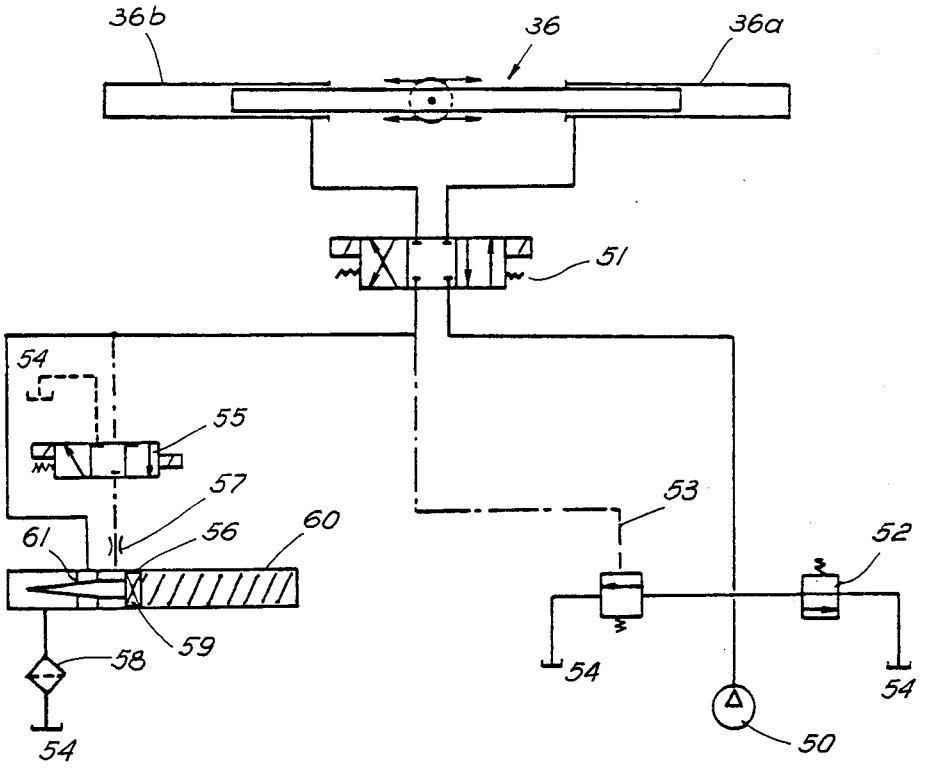
Figure 13:
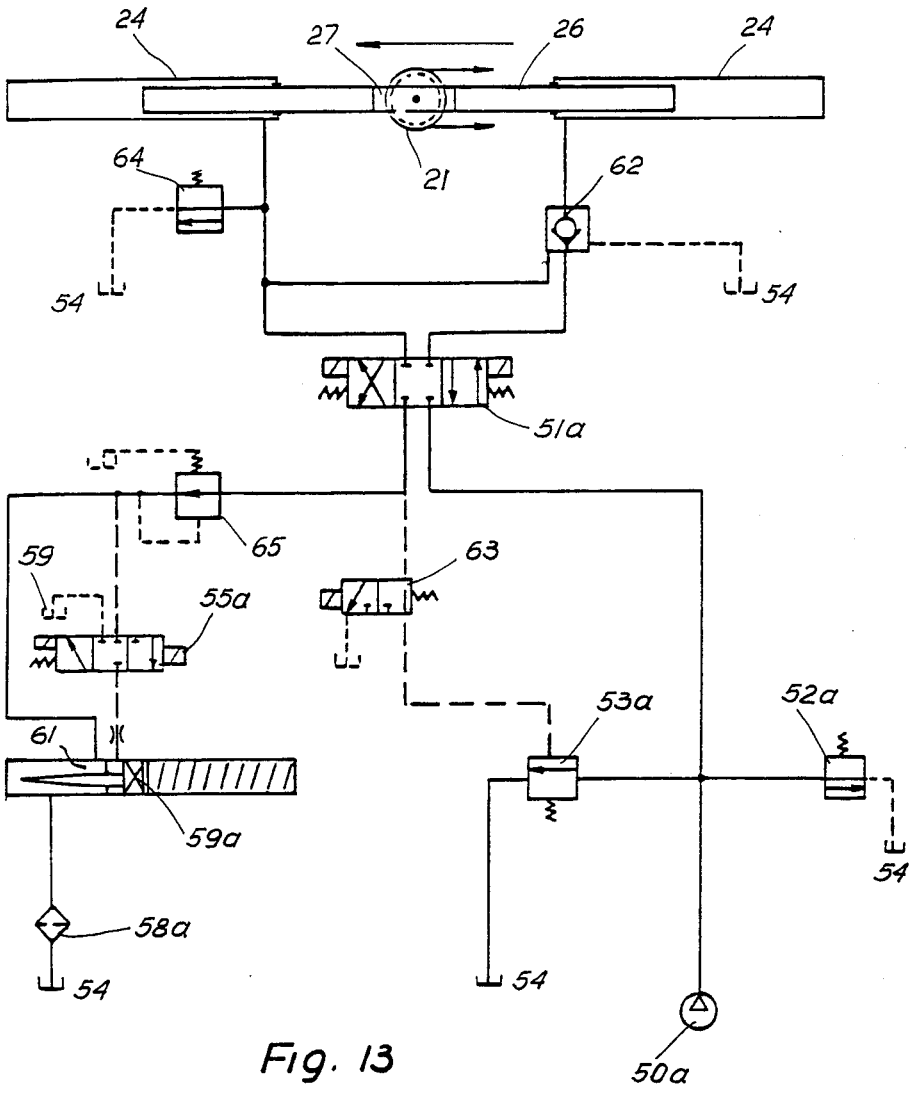
Figure 14:
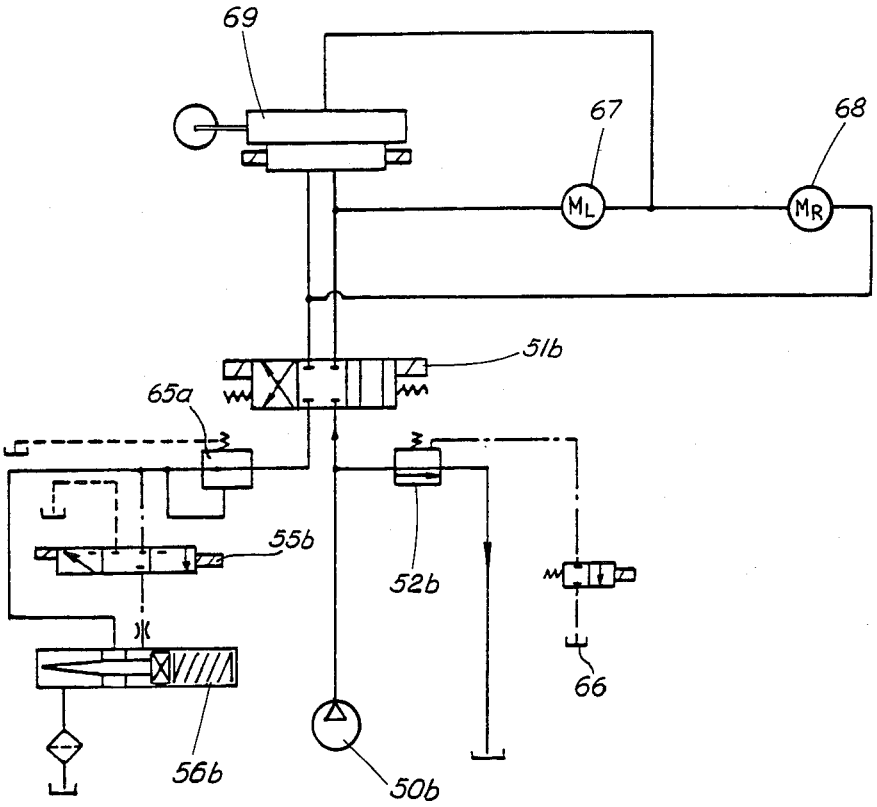

One preferred form of the invention and modifications thereof will now be described with reference to the accompanying drawings in which FIG. 1 is a part side elevation of a hydraulic crane according to the present invention, FIG. 2 is a plan view of a crane in the mode of a travelling bridge crane again embodying the present invention, FIG. 3 is a section through A—A on FIG. 1, FIG. 4 is an elevation of a hydraulic multiplying motor according to the present invention, FIG. 5 is a plan view of the motor as shown in FIG. 4, FIG. 6 is a detail of the cylinder head and sealing mechanism adopted therein, FIG. 7 is a section through B—B on FIG. 5, FIG. 8 is a section through C—C on FIG. 5, FIG. 9 is a section through D—D on FIG. 5, FIG. 10 is a schematic arrangement showing the rope reeving used for the hoist, FIG. 11 is a schematic view showing the rope reeving for the cross travel, FIG. 12 is the control circuit for the cross travel across the bridge, FIG. 13 is the hydraulic control circuit for the lifting and lowering, and FIG. 14 is the hydraulic control circuit for the long travel along the rails 4.

PREFERRED EMBODIMENT

The preferred form of the invention will be described with reference to a travelling bridge crane although it will be appreciated that the invention in its various aspects may in the main be applied to any structure where the load is to be lifted and traversed relative to the structure. This of course includes tower cranes and other installations of the like type and also includes Goliath cranes. The predominant application for the invention will however be in the travelling bridge crane normally found in workshops, warehouses or other areas requiring a lifting capacity.

The hydraulically operated crane 1 has as the main structural member 2 a cylindrical member formed by rolling or otherwise suitably forming from steel plates a member having a diameter consistent with the load to be lifted and the span. For example, with a 10 tonne crane of 20 meter span would involve a cylindrical member 2 having a diameter of approximately 1 meter. This cylindrical member is carried on end carriers 3 which in turn are supported on rails 4 carried in the usual manner on a suitable support structure, such as the top of a reinforced wall. It will be appreciated in the normal operation the rails 4 will be parallel rails and the bridge 2 will move backwards and forwards along those rails.

Attached to one side of the cylinder 2 is a substantially horizontal rail 5 and approximately diametrically opposed thereto is a further horizontal rail 6. A trolley 7 shown in FIG. 2 comprises a framework 8 hooked about the member 2 so that wheels 9 supported in the frame will engage with the rail 5 and wheels 10 will engage with the rail 6. In this way the trolley is supported hooked about the cylindrical structural member 2 with the load being carried as a tangential load to the structural member. In this way a torsional load is applied to the bridge or main structural member 2 which maximises the efficiency of the tubular member. Strengthening ribs 11 are welded internally in the cylindrical member 2 at intervals at approximately 1½ meters to minimise the likelihood of any localised buckling or failure as a consequence of the horizontal lods being applied to the member.

It will be appreciated that the configuration adopted for the bridge of the crane could have an application without necessarily involving the remaining components of the invention. However, it is highly desirable for this particular mode of bridge to be used in conjunction with the remainder of the invention as will be explained herebelow.

A lifting hook 12 is supported from a reeved block 13 by a rope 14 which passes about sheaves 15 and 16 fixed to the trolley 7. It is desirable for maximising manoeuvrability of the hook for the diameter of the sheaves 13, 15 and 16 and 17 and 18 to be kept as small as practicable. It will also be understood that in the drawing a single rope system has been illustrated for simplicity but the invention could readily be applied to a multiple and particularly a two rope lifting system. The rope 14 after passing about the trolley sheaves 15 and 16 extends to the end of the bridge to pass about end return sheaves 17 and 18. The rope 14 after passing about the end return sheaves 17 then passes about a diverter sheave 19 which is fixed to the structural bridge before being connected to the sheave carrier at sheave 20. The rope 14 after passing about the end return sheaves 18 runs directly to the sheave carrier at sheave 21.

The sheave carrier sheaves 20 and 21 are supported on a hydraulic multiplying linear motor 22 which is illustrated in more detail in FIGS. 5 to 9.

The linear hydraulic motor is of a particular design and while it has special application in the present invention would also be applicable in other areas. There are a number of important and novel features in the design adopted for the linear hydraulic motor.

The motor comprises two opposed cylinders 23 and 24 preferably being cylinders of the same diameter having operatively fitted therein piston rods 25 and 26 which are connected to the sheave carrier 27. The cylinders 23 and 24 are spaced apart by tie bars 28 with the operating distance of the linear motor controlled by the length of the tie bars.

A detail of the cylinder head as shown in FIG. 6, the piston 26 passes through a seal 29 and a guide bush 30 which is held in place by a retainer 31 bolted to the head by bolts 32. This particular construction allows for ease of maintenance in that split bushes can be removed when the bolts release the retainer and split seals are also designed to facilitate on-site maintenance.

Each of the pistons 25 and 26 is hollow with the stopped end adjacent the sheave carrier. The volume in each of the cylinders and pistons is the same so that upon the sheave carrier being reciprocated through the operating distance the oil displaced from one equates with the oil introduced to the other. In this way there is no change of oil in the reverse tank enabling a sealed system to be used or at least minimising the air movement into or out of the tank which as explained previously has deleterious effects in the operation of the system.

The reeving system just described is schematically illustrated in FIG. 10 and provides a balanced fleet through system. The return sheaves 17 and 18 are fixed to the support structure as is also the diverter sheave 19.

The rope 14 is anchored at two points 32 and 33 in a plate 34 which is fixed at an angle to the end of the cylinder 24. This configuration is shown most clearly in FIG. 10 and it is designed so that the friction forces which operate on the piston are balanced. The end 125 of the cylinder 23 is designed to be pinned to the support structure and the structure is also suppoted on a stand from underneath on flexible brackets at each of the cylnder heads. In this way a stable structure is provided which will ensure that the linear hydraulic motor operates in a manner which will place the minimum stress and hence cause minimum wear to the seals. The possibility of any sag caused through the weight of the reeved sheaves, sheave carrier and pistons is to some extent off-set by the hollow pistons which are filled with oil under pressure and therefore tend to straighten underb the bourdon effect. Sag is further reduced by the straightening effect of the hydraulic forces set up in the tie rods combined with the vertical flexibility of the supports so that as the bridge sags under load the reverse effect occurs on the engine.

The hydraulic control system will be described in detail hereafter but the pressure in the cylinders 23 and 24 are arranged such that the tie rods are always in tension. The cylinder 24 is the main operating cylinder and the cylinder 23 is a control cylinder which although playing a more minor role is still very significant from the point of view of operating of the linear motor and control.

With reference to FIG. 10 it will be apparent that operation of the linear motor reciprocates the reeved sheaves 20 and 21. As these sheaves are moved to the left, the hook will be raised and as the sheaves are moved to the right the hook will be lowered. In either mode the rope 14 is either taken up or let down about the trolley sheaves 15 and 16 equally and this is caused because the rope 14 from the anchor point 32 passes about the sheave 20 and the deflector sheave 19 prior to returning to the end return sheave 17, in this way as the sheaves 20 and 21 move to the left the rope 14 will shorten the length of the rope dependant from the sheave 15. Similarly taking the rope from the anchor point 33 it passes about the sheave 21 and then the end return sheaves 18 to the sheave 16. Movement in the same direction will also cause the rope to be raised about the sheave 16.

This balanced fleet through system has a number of control advantages in that there is the minimum need to introduce braking or other controls to otherwise off-set eccentric or out of balance loads which can develop in the system. The movement is more controlled and there is less likelihood of any jerking or rapid movement because of slack or rope stretch in the system when there is a change in the directional movement. In the illustrated example the linear motor has a multiplying effect of 4 but this could be increased by introducing more sheaves in the system if this was desired. With the illustrated example 1 meter of travel in the sheave carrier attached to the linear motor results in 2 meters of movement of the hook. Thus the operating stroke of the linear motor needs to be half of the required hook lift because of the peculiar and special features described such a distance of linear movement is feasible and normally the more complex reeving pattern which would be involved with more sheaves attached to the linear motor can be avoided.

Another peculiar advantage which can be achieved in the combined application of aspects according to the present invention is illustrated in FIGS. 1 to 3 of the drawings where the linear motor and associated sheaves and rope reeving can be mounted inside the cylindrical bridge 2 and below the neutral axis of the girder. This has a number of significant advantages. First, the lines of the completed crane are clean without any significant rope visibility in excess of that which would be visible in a conventional crane. The linear motor described is intended to minimise wear on components and hence should not be prone to leakage. However, in the event of any leakage occurring the oil would be discharged into the cylinder 2 and would not therefore fall into the area being serviced by the crane. Secondly, the position of the linear motors below the neutral axis of the girder not only reduces the deflection under load but also reduces the tensile stress in the girder. The effect is accentuated by the large forces created by the multiplying of the hoist ropes. Finally, by confining the motor and associated reeving system in the bridge it is confined and will not accumulate as much dirt as might otherwise be the case.

It is also necessary to ensure that the trolley 7 can be traversed across the bridge 2. This traversing motion is achieved using a secondary linear motor 36 which is also located in the preferred embodiment within the bridge member 2. The linear motor has not been specifically detailed in the drawings but a schematic showing the operation is illustrated in FIG. 11. The rope 37 is attached to the trolley 7 at points 38 and 39. The rope 37 passes about end return reeves 40 and 41 before returning to the sheave carrier 42 and the anchor sheaves 43 and 44. The operation of this system is similar but simpler to that previously described. Movement of the linear motor 36 in one direction causes the trolley 7 to move across the bridge in one direction and movement in the opposite direction causes the return of the trolley. In this case as is illustrated there is a multiplying factor of 6 to 1 which means that the length of stroke required in the linear motor 36 can be less than that required in the main lifting linear motor.

For light duty work the convention winch drum with an endless rope driven by a single hydraulic motor would be suitable.

The hydraulic circuitry and control required is also designed to achieve specific advantages. In the drawings an electric motor 45 is mounted on a frame 46 associated with one end carriage. The electric motor drives a hydraulic pump which together with the hydraulic reservoir tank is housed in the chamber 47. The electrical control equipment necessary is also housed in this chamber.

The hydraulic control circuit necessary to operate the crane will be described herebelow. The hydraulic circuits have been designed to achieve the following unique operating features. First, an operator may select any desired operating speed from almost zero to the maximum achievable by the system using a simple standard double depression type of pendant push button control station. Secondly, both positive and negative acceleration can be maintained constant irrespective of the load and are outside the control of the operator. The circuit adopted has a basic common factor which is applied to the lifting and the lowering of the load, the traversing of the trolley across the crane and the traversing of the bridge along the rails 4 where a bridge crane control is applied.

This common factor is based on the meter out principle of speed control which is to control the oil flow through the driving means by throttling the motion exhausts while the pump itself continues to run at full speed and full flow. There are many advantages which are gained from this system, but the main ones are stability as the driving means is always to some extent driven even when braking overrunning loads as it occurs on the long travel and lowering and the fact that it facilitates pump pressure unloading at light loads on the crane hook and also facilitates the use of the desirable, simple and inexpensive fixed displacement pump. However, this does not preclude the use of a single variable displacement pressure compensated fro certain applications.

The control circuit will first be described with reference to FIG. 12 which is the circuit for the cross travel of the trolley on the bridge. In the circuits like components will be given like numbers and the positive displacement pump 50 driven by the electric motor 45 shown on the preceding drawings causes the oil to flow to the directional control valve 51 to the linear motor 36. The valve 51 is energised by the operator control and the directional arrows indicate the circuit connections possible. It is therefore apparent that in one position the pump will deliver oil under pressure to the side 36*a* and in the other position the high pressure will be delivered to the side 36*b*. A relief valve 52 allows for oil to be exhausted in the event of excessive pressure build up. A spill-off valve 53 operates to control the pressure on the exhaust side of the circuit. This pressure has been set approximately 50 psi and if this pressure is exceeded the spill-off valve 9 operates allowing a bypass of oil back to the tank 54.

An interface valve 55 connects the exhaust circuit to the metering valve 56 and thence back to the tank 54. The interface valve is capable of assuming three positions. In the centre position illustrated the valve is closed preventing any passage of oil. If the interface valve is moved to the left oil can flow through to the metering valve 56. If the valve is moved to the right oil from the metering valve can flow through to exhaust to the tank 54.

The interface valve is important and must be able to assume any one of the three stated positions. To achieve this it is necessary for the control mechanism to be able to assume any one of the three stated positions. This can be achieved using a valve with two solenoids. One solenoid operating as a push solenoid to move the valve to the central position and the second solenoid operating to take over to move the valve to the accelerating mode if the control circuit is so actuated.

The flow of oil in the control circuit from the interface valve 55 into the metering valve 56 must be regulated so that there is the same pressure drop irrespective of operating mode. As indicated above the pressure on the exhaust side through the spill-off valve is controlled at 50 psi. A control aperture 57 in the line between the interface valve and the metering valve results in a drop of pressure of half so that pressure at 50 psi is delivered to the metering valve at a pressure of 25 psi. When the interface valve is changed over to the decelerating mode the oil in the control chamber of the metering valve 56 is allowed to exhaust back to tank again through the orifice 57 resulting in a further drop in pressure of 25 pounds, that is from the 25 pounds in the chamber to 0. This means that the flow in either direction is the same resulting in both acceleration and braking or deceleration functioning at the same rate. The metering valve 56 is designed to control the rate at which oil in the exhaust circuit can pass back to the tank 54 through the filter 58. If the operator at the control mechanism pushes the controls necessary for acceleration the interface valve moves in the drawing to the left so that the 50 pound psi pressure can pass through the valve and through the orifice 57 to the metering chamber. This oil causes the piston 59 to be moved against the spring 60 opening the aperture 61 and thereby regulating the rate of oil which can be discharged through to the tank. As soon as the control circuit is set back to the central position the piston 59 is retained in the same position and hence the rate of movement of the motion remains constant. As soon as the interface valve is moved to the braking or the deceleration mode oil is displaced by the spring 60 to pass through the orifice 57 and valve 55 back to the tank 54. The rate at which this oil is discharged and hence the rate at which the orifice 61 is closed is again the same as that for acceleration. It will be apparent that this mode of operation is quite independent of the operator who can select a speed by actuating the controls but cannot control the rate at which that speed is increased or decreased and this is an important control function in the present invention.

Instad of using a biassing spring the piston 59 can also be positioned using a convention single three position closed centre directional control valve operated by solenoids as described above.

If we now consider FIG. 14 the circuit for controlling the hoisting and lowering is illustrated. In this instance the hydraulic linear motor having the cylinders 23 and 24 is shown connected to the sheave carrier 27. In this case because of special protective requirements additional valves are introduced. It is necessary for the circuit to include protection in the event of failure so that the load will not be dropped. This is achieved by including a drop check valve 62. Any failure in pressure will cause this valve to close and hold the load at the position adopted when the failure occurred. To enable the lowering circuit to operate it is necessary for a pilot control to maintain the drop check valve during the lowering mode. This increases the pressure in the exhaust side and to prevent the spill-off valve 53*a* operating at that time a solenoid valve 63 is used which can isolate the spill-off valve 53*a*. It is still necessary to have some pressure relief in the circuit and a pressure relief valve 64 is introduced to allow the exhaust oil to be spilled to tank at low pressure and to provide the low pressure protection necessary for the cylinder 24. With these modifications the circuit is essentially the same as that previously described. The constant displacement pump passes oil through the directional control valve and when the valve is arranged for lifting it is displaced to the left. Pressure is exerted in the cylinder 24 and the pressure in the exhaust circuit is retained at the 50 pounds per square inch previously referred to which operates through the interface valve and metering valve to effect the speed and acceleration control as previously described. In the lowering mode the solenoid valve 63 is energised thereby cutting out the valve 53*a*. The oil is exhausted through valve 64 to tank 54 and at the same time sufficient pressure is caused to open the drop check valve 62. The speed and acceleration control is maintained in the same mode as that previously described. As the valve 53*a* is not functioning in this mode it is also necessary to introduce a pressure reducing valve 65 so that the pressure applied to the speed and acceleration control through the interface and metering valve is maintained at 50 psi. The long travel circuit follows again a similar operating criteria and is illustrated in FIG. 14. In this case two separate hydraulic motors 67 and 68 are located on each side of the travelling bridge and are connected to the wheels of the bridge so that they will provide motive power to cause one side or the other side of the bridge to be moved. A sensor 69 is connected to the bridge on one side and operates from one of the horizontal rails or any other datum reference point selected to control the speeds of the motors and hence maintain the bridge in the correct configuration. The operator mode through the directional control valve is similar to that previously described as is also the interface and speed and acceleration control. The control circuit when in the braking mode has the motors 67 and 68 operating effectively as pumps. It is therefore desirable to ensure that the oil displaced by the pump 50*b* does not further contribute to the pressures which will build up. To this end a pressure relief valve 66 has been incorporated which will unload the main relief valve 52*b* in the standstill or braking conditions.

The directional control valves 51 and 51*b* are closed centre valves so that when the controls are in the neutral position the valve is set to block the flow of oil to or from the motors controlling either the linear movement across the bridge or the motors controlling the long travel motion along the rail. This effectively operates as parking brakes for the crane.

What is claimed is:

1. A hydraulically operated crane comprising a support structure having a hollow cylindrical travelling bridge, trolley tracks on said cylindrical travelling bridge to support the trolley to a side of said travelling bridge, a hoist block supported from said trolley, a balanced fleet through rope and reeve system supported by said structure to control the lifting and lowering of the hoist block, a hydraulic multiplying linear motor having one end anchored in the support structure to provide operating power for the hoist block, said linear motor having twin opposed hydraulic cylinders, tie rods connecting the cylinders in line with the length of tie rods between adjacent ends of the cylinders determining the operating stroke of the linear motor, a reeve sheave carrier connected in the space between the cylinders to each operating piston extending from the cylinders, two reeve sheaves mounted on said reeve sheave carrier, end return sheaves at each end of said support structure, two trolley sheaves mounted on said trolley and a diverter sheave supported in said support structure with the operating rope for the hoist block having the ends anchored to a support base associated with the linear motor with the rope from one anchor point passing about one reeve sheave mounted on the reeve carrier supported by the pistons of the linear motor, and the end return sheaves at the end of the structure before being returned to the trolley sheave and about the hoist block and the rope from the other anchor point passing about the second reeve sheave on the reeve carrier supported by the pistons of the linear motor and about the diverter sheave before returning to pass about the end return sheaves at the opposite end of the structure and then to the second trolley sheave about the hoist block.

2. A hydraulically operated crane comprising a support structure, trolley tracks on said support structure, a trolley supported on said tracks, a hoist block supported from said trolley, a balanced fleet through rope and reeve system supported by said structure to control the lifting and lowering of the hoist block, a hydraulic multiplying linear motor having one end anchored in the support structure to provide operating power for the hoist block, said linear motor having twin opposed hydraulic cylinders, tie rods connecting the cylinders in line with the length of tie rods between adjacent ends of the cylinders determining the operating stroke of the linear motor, a reeve sheave carrier connected in the space between the cylinders to each operating piston extending from the cylinders, two reeve sheaves mounted on said reeve sheave carrier, end return sheaves at each end of said support structure, two trolley sheaves mounted on said trolley and a diverter sheave supported in said support structure with the operating rope for the hoist block having the ends anchored to a support base associated with the linear motor with the rope from one anchor point passing about one reeve sheave mounted on the reeve carrier supported by the pistons of the linear motor, and the end return sheaves at the end of the structure before being returned to the trolley sheave and about the hoist block and the rope from the other anchor point passing about the second reeve sheave on the reeve carrier supported by the pistons of the linear motor and about the diverter sheave before returning to pass about the end return sheaves at the opposite end of the structure and then to the second trolley sheave about the hoist block.

3. A crane as claimed in claim 2 wherein the pistons in the linear motor are hollow with stopped ends adjacent the reeve carrier so that in use the interior of the piston is filled with oil under pressure.

4. A crane as claimed in claim 2 wherein the ends of the rope for the hoist block are mounted on a mounting plate fixed to the end of one cylinder and at an angle designed so that the frictional forces which operate on the piston are balanced.

5. A crane as claimed in claim 2 wherein the suport structure comprises a hollow cylindrical travelling bridge with trolley tracks on said cylindrical travelling bridge to support the trolley to the side of said cylindrical travelling bridge.

6. A crane as claimed in claim 5 wherein the linear motor and associated sheaves and rope reeving used in the crane are mounted within the cylindrical travelling bridge.

7. A crane as claimed in claim 2 wherein the traversing mechanism for the trollery comprises a rope and sheave system with the actuating power for this system being provided by a hydraulic multiplying linear motor.

8. A crane as claimed in claim 2 wherein a greater number of reeve blocks may be supported by the reeve carrier to provide a greater mechanical advantage between the operating stroke of linear motor and the distance moved by the hoist blocks.

9. A crane as claimed in claim 2 wherein the hydraulic control circuit for the crane includes a hydraulic pump, a directional control valve to actuate the hydraulic motor in a forward or reverse direction and to connect the exhaust circuits to a control valve and metering valve with the control and metering valves used to regulate the speed and acceleration of the hydraulic motor.

10. A crane as claimed in claim 9 wherein the control valve delivers a flow of oil to the metering valve, which metering valve incorporates positioning means operable to control a needle valve with the rate at which the oil is delivered to the metering valve and the rate at which the oil is discharged the metering valve and the control valve being the same and independent of an operator control.

* * * * *